US009469519B2

(12) United States Patent
Keeling

(10) Patent No.: US 9,469,519 B2
(45) Date of Patent: Oct. 18, 2016

(54) SYSTEM FOR REDUCING FOAM AT A TAP

(71) Applicant: Todd Keeling, New Lenox, IL (US)

(72) Inventor: Todd Keeling, New Lenox, IL (US)

(73) Assignee: Todd Keeling, Frankfort, IL (US)

( * ) Notice: Subject to any disclaimer, the term of this patent is extended or adjusted under 35 U.S.C. 154(b) by 0 days.

(21) Appl. No.: 14/551,769

(22) Filed: Nov. 24, 2014

(65) Prior Publication Data

US 2015/0075673 A1 Mar. 19, 2015

Related U.S. Application Data

(63) Continuation of application No. 13/557,946, filed on Jul. 25, 2012, now abandoned.

(51) Int. Cl.

| | |
|---|---|
| ***B67D 7/00*** | (2010.01) |
| ***B67D 1/08*** | (2006.01) |
| ***B67D 1/14*** | (2006.01) |
| ***B67D 1/00*** | (2006.01) |

(52) U.S. Cl.

CPC ..... *B67D 7/005* (2013.01); *B67D 1/0003* (2013.01); *B67D 1/0082* (2013.01); *B67D 1/08* (2013.01); *B67D 1/1411* (2013.01); *B67D 1/1422* (2013.01)

(58) Field of Classification Search

CPC .... B67D 1/14; B67D 1/1422; B67D 1/1272; B67D 7/005

USPC ..... 141/374; 222/567

See application file for complete search history.

(56) References Cited

U.S. PATENT DOCUMENTS

| | | | |
|---|---|---|---|
| 667,188 | A | 2/1901 | Clavez |
| 2,720,562 | A | 2/1903 | Castle |
| 1,369,621 | A | 2/1921 | Comstock |
| 1,732,753 | A | 7/1928 | Hunt et al. |
| 2,750,079 | A | 6/1956 | Trombley |
| 2,811,179 | A | 10/1957 | Greenwood |
| 3,106,231 | A | 10/1963 | Lehmann |
| 3,402,857 | A | 9/1968 | Ecklund et al. |
| 4,398,652 | A | 8/1983 | Ueda et al. |
| D273,453 | S | 4/1984 | Knopf |
| 4,494,681 | A | 1/1985 | Ueda et al. |
| 4,606,382 | A | 8/1986 | Biller et al. |
| 4,685,598 | A | 8/1987 | Nezworski |
| 5,758,698 | A | 6/1998 | Kaneko |
| 6,234,223 | B1 | 5/2001 | Nelson |
| 6,237,652 | B1 | 5/2001 | Nelson |
| 6,397,909 | B1 | 6/2002 | Nelson |
| D475,241 | S | 6/2003 | Mattiuzzo |
| 6,669,051 | B1 | 12/2003 | Phallen et al. |
| 6,827,238 | B2 | 12/2004 | Barker et al. |
| 6,938,878 | B2 | 9/2005 | Tonati |
| 7,040,359 | B2 | 5/2006 | Younkle |
| 7,278,454 | B2 | 10/2007 | Younkle |
| D612,203 | S | 3/2010 | Bollin |

(Continued)

FOREIGN PATENT DOCUMENTS

| | | |
|---|---|---|
| CN | 201909082 | 7/2011 |
| DE | 29716347 | 12/1997 |

(Continued)

*Primary Examiner* — Timothy L Maust

(74) *Attorney, Agent, or Firm* — Vedder Price P.C.; Robert S. Beiser

(57) ABSTRACT

This invention relates to a new nozzle for a beer valve tap and a new foamless beer tap dispensing system. The new nozzle is longer, has a small bent and end openings for a more precise release of beer from the outlet of the spout.

8 Claims, 2 Drawing Sheets

(56) References Cited

U.S. PATENT DOCUMENTS

| | | | |
|---|---|---|---|
| 7,730,912 | B2 | 6/2010 | Blichmann |
| 7,815,078 | B2 | 10/2010 | Robinson |
| 7,815,079 | B2 | 10/2010 | Saveliev et al. |
| 7,823,411 | B2 | 11/2010 | Gagliano et al. |
| 2003/0006254 | A1 | 1/2003 | Itou et al. |
| 2007/0151992 | A1 | 7/2007 | Carlson et al. |
| 2008/0224080 | A1 | 9/2008 | Miller |

FOREIGN PATENT DOCUMENTS

| | | |
|---|---|---|
| GB | 2178003 | 2/1987 |
| GB | 2322691 | 9/1998 |
| GB | 2447920 | 10/2008 |

SYSTEM FOR REDUCING FOAM AT A TAP

CROSS REFERENCE TO RELATED APPLICATIONS

This application is a continuation of U.S. patent application Ser. No. 13/557,946, filed on Jul. 25, 2012, entitled "System for Reducing Foam at a Tap", the contents of which is herein incorporated by reference in its entirety.

FIELD OF THE INVENTION

This invention relates to a new nozzle for a beer valve tap, and a new foamless beer tap dispensing system. The new nozzle is longer, has a small bent and end openings for a more precise release of beer from the outlet of the spout.

BACKGROUND

Many drinks and beverages are dispensed in different contexts using taps. For example, in bars an owner obtains a large volume of a beverage, generally described as a keg that is pressurized. The liquid beverage is released from the keg through a series of tubes and valves up to a point where the liquid is dispensed at the outlet of a spout. Because of the pressure and gas content of certain beverages like beer, upon dispense at the tap, there is a creation of foam.

Foam is sometimes desirable to protect the upper surface of a beer from oxidation with air, but too much of a foam collar on beer results in waste and loss of time by having to remove the foam from the glass in which the beer is poured. Bartenders use tools and skill to remove the excess foam resulting in drips of beer and glasses that may be sticky for the patron.

One of the problem with the creation of an undesirable quantity of foam is the impact of the beer with the bottom of a long and tall glass. Because of the height of the glass and the gas content of the beverage being poured and depressurized, a greater impact allows for the release of a greater quantity of gas from within the liquid and thus a larger amount of foam. What is needed is a new system and tap nozzle that allows for the pouring of any pressurized beverage like for example beer by limiting the volume of foam.

SUMMARY

The present invention relates to a new longer nozzle for a beer valve tap, and a new foamless beer tap dispensing system having end grooves or openings to allow for the proper expansion of the depressurizing fluid at the tip of the spout.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
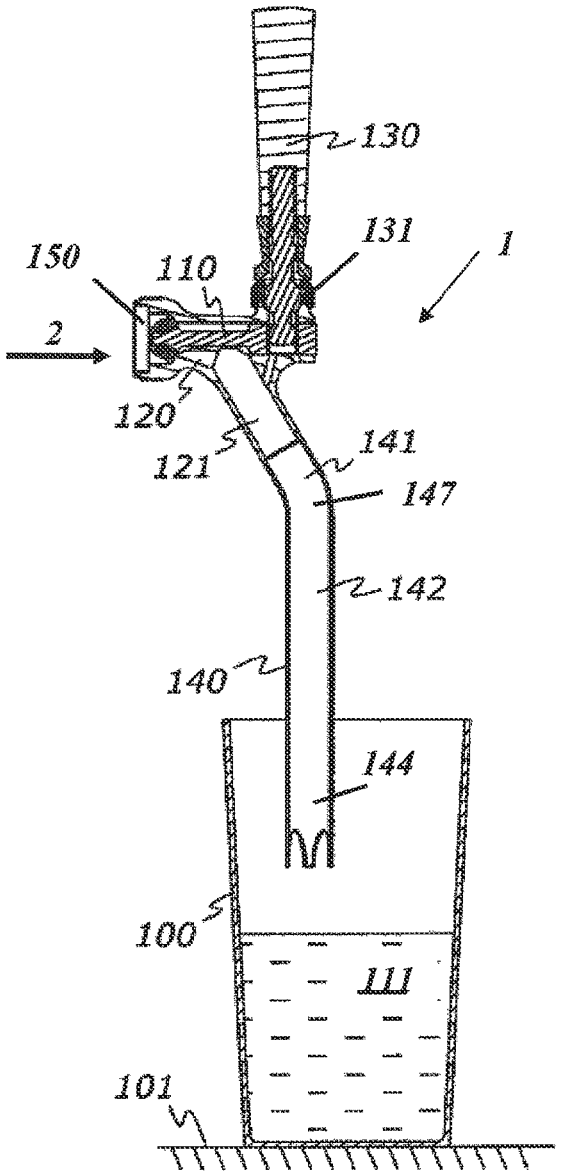
FIG. 1 an illustration of the beverage dispenser system with extended spout in accordance this invention.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one skilled in the art to which this disclosure relates.

Figure 3:
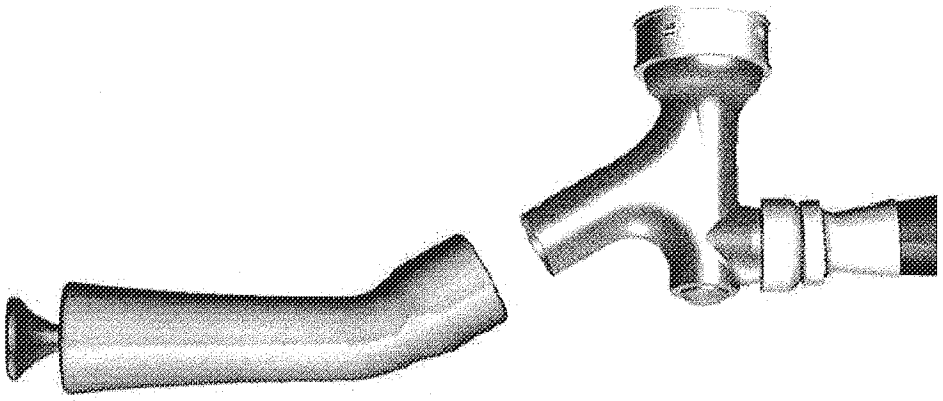
FIGURE 3 (PRIOR ART)
FIG. 3 is an illustration of a product called the TurboTap® from the Prior Art.

FIG. 3 shows a product from the prior art called the TurboTap® from Micromatic, Inc. In this device, the system is designed to accommodate an increased flow of beer into a glass. As a result from the faster flow, more foam is produced. In the central portion of the tip of this device, a metal piece diverts the flow of beer sideways. The problems with this device include the need to clean the internal mechanism. What is needed is a device to reduce the foaming of beer without the use of moving or inter pieces that require maintenance and repair.

FIG. 1 shows a system 1 for dispensing a beverage like beer from a source 2 down to a container 100. As shown at FIG. 1, the container 100 includes a portion of liquid 111 from the source 2 as poured through the system 1. In this embodiment, a glass is shown as the container 100 but any other container may be contemplated as known by one of ordinary skill in the art.

The container 100 is then placed on a flat horizontal surface 101 such as a table. As shown in the embodiment, the new extended spout 140 is attached to the normal end 150 of the known tip 121 of a traditional tap. The extended spout 140 includes a connection section 141 that can be screwed on, clipped on, or even permanently affixed to the tip 121. In a preferred embodiment, the internal diameter of the connection section 141 and the tip 121 are relatively similar to help with the internal flow of the source 2 from a storage and pressurized container down to the container 100.

The extended spout 140 includes, a curved section 147 adjacent to the connection section 141 and a straight section 142 on the dispensing section 144 adjacent to the curved section 147, the internal diameter of the connection section, the curved section and the straight section being substantially identical to prevent foam from buildup during dispensing of the beer. At the end of the dispensing section 144 better shown at FIG. 2, lateral grooves or openings 143 are found. Returning to FIG. 1, the length of the dispensing section 144 and ultimately the length of the extended spout 140 is designed in such a way to allow for the tilting of the container 100 in place and the removal of the container 100 over the dispensing section 144 without the spill of too much of the liquid 111 from within the container 100.

Figure 2:
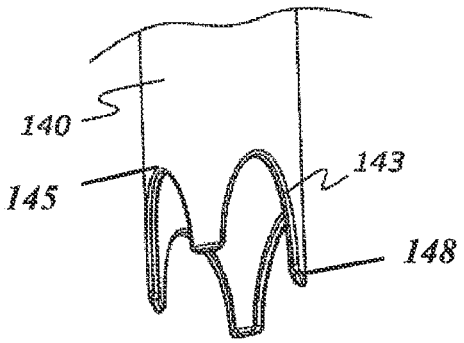
FIG. 2 is a close up view of the end portion of the extended spout shown at FIG. 1.

As shown at FIG. 2, the openings 143 are shown with a thin tapered edge relative to the thickness of the dispensing section to help smooth the passage of the fluid. The openings 143 are also shown with a rounded upper edge 145 that allows for a progressive increase of the lateral section of flow. For example, as the liquid 101 enters the dispensing section and travels over the openings 143, the liquid 111 expands slowly and progressively outwards as forward in the pouring direction. The gradual expansion of the pressurized liquid 111 in a depressurized state allows to control the release of gas in suspension in the liquid 111. As shown, four openings 143 are located between two horizontal flaps 148 that allows for the protection of the container 100 in which the extended spout 140 is slid.

As a container 100 made of brittle material such as glass, the rounded upper edges 145 of the dispensing section 144 allows to prevent any breakage of the brittle media. While one type of openings 143 is shown, what is contemplated is the use of any types of openings, for example small holes, slits, and other vents.

FIG. 1 also shows the other elements of the system 1 that include a handle 130 connected to a pivot 131 for pushing inwards and outwardly a valve spool 110 who in turn allows for the liquid 111 to flow from the source 2 into an inlet 150 down through a passage 120 of the system 1 to the container 100 via the tip 121 and the extended spout 140.

In one embodiment, the extended sprout 140 is long enough to reach more than 50% down into the container 100. In another embodiment, the extended spout 140 can reach less than 50% down into the container 100. In one embodiment, the thickness of the extended sprout 140 can be 1.5 mm or more.

What is described is a system 1 for dispensing a pressurized beverage 111 from a source 2 into a container 100. The system 1 includes a container 100 for receiving a liquid 111 from a pressurized source 2, a tap 120 with a handle 130 with a pivot 131 for activating a valve spool 110 for allowing the liquid 111 from the pressurized source 2 to flow to a tip 121 of the tap 120, and an extended spout 140 with an internal opening for the passage of the liquid from the pressurized source 2 to the container 199 that comprises a connection section 141 connected to the tip 121, a curved section 147 adjacent to the connection section 141, a straight section 142, and a dispensing section 144, and wherein the dispensing section 144 includes a plurality of openings 143.

In one preferred embodiment, unlike the device from the prior art, the system 1 is designed to be able to poor liquid 111 into the container 100 even if the dispensing section 144 rests at the bottom of the container 100 or is at any portion in the container 100. The extended spout 140 can be 3.75, 4.75 or 5.75 inches long. In other embodiments, the extended spout 140 can be shaped and of a length adapted to the type of container 100 to be served.

Finally, in many instances, the liquid 111 within the source 2 is cold and customers enjoy receiving the liquid 111 in the container 100 as cold as possible. In earlier models of taps as shown in the prior art at FIG. 1, the liquid 111 is disturbed and redirected laterally and this change in direction has for consequence the heating of the liquid 111 in motion. The new system 1 allows for the liquid to rest in the container 100 with as little movement and heating as possible preserving the cold temperature of the liquid 100. Further, since less metal/material is needed at the tip 121 of the spout 140 when compared with the prior art of FIG. 1, this new system 1 will transfer in average less heat to the liquid 100 keeping it cold.

It is understood that the preceding is merely a detailed description of some examples and embodiments of the present invention and that numerous changes to the disclosed embodiments can be made in accordance with the disclosure made herein without departing from the spirit or scope of the invention. The preceding description, therefore, is not meant to limit the scope of the invention but to provide sufficient disclosure to one of ordinary skill in the art to practice the invention without undue burden.

What is claimed is:

1. A system for dispensing beer from a source into a container, the system comprising:

a container for receiving beer from a pressurized source;

a beer tap with a handle with a pivot for activating a valve spool for allowing the beer from the pressurized source to flow to a tip of the beer tap; and an extended one piece spout with an opening for the passage of the beer from the pressurized source to the container that comprises a connection section connected to the tip, a curved section adjacent to the connection section, a straight section, and a dispensing section, and wherein the dispensing section includes a plurality of lateral openings; the internal diameter of the connection section, the curved section and the straight section being substantially identical to prevent beer foam buildup, wherein each of the plurality of lateral openings includes a thin tapered edge relative to the thickness of the dispensing section to prevent beer foam buildup; and wherein the plurality of lateral openings create a plurality of horizontal flaps between each opening.

2. The system of claim 1, wherein the dispensing section is inserted inside of the container at least 50%.

3. The system of claim 1, wherein the extended spout is of a thickness of 1.5 mm or more.

4. The system of claim 1, wherein each of the plurality of lateral openings further include at least an upper rounded edge.

5. A beer tap for reducing the foam of a beer from a source into a container, the system comprising:

a beer tap with a handle with a pivot for activating a valve spool for allowing the beer from the pressurized source to flow to a tip of the beer tap, and an extended one piece spout with an opening for the passage of the beer from the pressurized source to the container that comprises a connection section connected to the tip, a curved section adjacent to the connection section, a straight section, and a dispensing section, and wherein the dispensing section includes a plurality of lateral openings, the internal diameter of the connection section, the curved section and the straight section being substantially identical to prevent beer foam buildup, wherein each of the plurality of openings includes an edge then tapered relative to the thickness of the dispensing section to prevent beer foam buildup; and wherein the plurality of lateral openings create a plurality of horizontal flaps between each opening.

6. The tap of claim 5, wherein the dispensing section is inserted inside of the container at least 50%.

7. The tap of claim 5, wherein the extended spout is of a thickness of 1.5 mm or more.

8. The tap of claim 5, wherein each of the plurality of openings further include at least an upper rounded edge.

* * * * *